US008701248B2

(12) United States Patent
Dries

(10) Patent No.: US 8,701,248 B2
(45) Date of Patent: Apr. 22, 2014

(54) DOOR CONSTRUCTION WITH CLOSING PIVOT HINGES INTEGRATED INTO DOOR PANEL

(75) Inventor: Rudi Dries, Belgium (BE)

(73) Assignee: Liexco, S.A., Luxembourg (LU)

( * ) Notice: Subject to any disclaimer, the term of this patent is extended or adjusted under 35 U.S.C. 154(b) by 208 days.

(21) Appl. No.: 13/054,620

(22) PCT Filed: Jul. 17, 2009

(86) PCT No.: PCT/IB2009/053122
§ 371 (c)(1),
(2), (4) Date: May 12, 2011

(87) PCT Pub. No.: WO2010/007599
PCT Pub. Date: Jan. 21, 2010

(65) Prior Publication Data

US 2011/0232036 A1 Sep. 29, 2011

(30) Foreign Application Priority Data

Jul. 18, 2008 (BE) ..... 2008/0405

(51) Int. Cl.
*E05F 1/14* (2006.01)
*E05F 1/08* (2006.01)
*E05D 7/06* (2006.01)

(52) U.S. Cl.
USPC ..... 16/280; 16/284; 16/303; 16/309; 16/312; 49/236; 49/245

(58) Field of Classification Search
USPC ..... 16/280, 284, 309, 312, 315, 318, 281, 16/291, 321, 325, 378, 379, 285, 297, 16/303; 49/236, 237, 238, 239, 245, 242
See application file for complete search history.

(56) References Cited

U.S. PATENT DOCUMENTS

| | | | | | |
|---|---|---|---|---|---|
| 1,996,196 | A | * | 4/1935 | Ferris | 119/523 |
| 306,308 | A | | 11/1962 | Greenman | |
| 3,063,089 | A | * | 11/1962 | Greenman | 16/303 |
| 495,135 | A | | 8/1990 | Eckel | |

(Continued)

FOREIGN PATENT DOCUMENTS

| | | | | |
|---|---|---|---|---|
| CH | 346131 | | 4/1960 | |
| NL | 1021237 | | 4/2003 | |
| WO | WO 2008009736 | | 1/2008 | |
| WO | WO 2008009736 | A1 * | 1/2008 | E05F 1/12 |

*Primary Examiner* — Emily Morgan
(74) *Attorney, Agent, or Firm* — Jerold I. Schneider; Schneider Rothman IP Law Group

(57) ABSTRACT

Door construction includes a door panel and at the top and at the bottom each time a self-closing pivot hinge. Each of the pivot hinges includes a spring which extends along the rotation axle and which provides a self-closing function to the pivot hinge. Each of the pivot hinges includes a first cam element and a second cam element which are pushed onto each other by the spring and push the door panel towards the closed position under the influence of the spring pressure. The first cam element includes at least one protrusion which upon rotation runs along a running surface with inclined parts of the second cam element. The second cam element is movably mounted in longitudinal direction of the pivot axle by means of a pen which is accommodated in a slotted hole of the second cam element. The slotted hole extends at least partly between the inclined parts of the running surface.

15 Claims, 9 Drawing Sheets

(56) References Cited

U.S. PATENT DOCUMENTS 4,951,351 A * 8/1990 Eckel ..... 16/284
5,600,868 A * 2/1997 Tourville et al. ..... 16/277
7,150,072 B2 * 12/2006 Huang et al. ..... 16/312
7,328,483 B2 * 2/2008 Chen et al. ..... 16/303
7,814,619 B2 * 10/2010 Kuwajima et al. ..... 16/303
2004/0034964 A1 2/2004 Loggen et al.

* cited by examiner

DOOR CONSTRUCTION WITH CLOSING PIVOT HINGES INTEGRATED INTO DOOR PANEL

CROSS-REFERENCE TO RELATED APPLICATIONS

This application is the United States National Stage of PCT Application No. PCT/IB2009/053122 filed 17 Jul. 2009, which claims priority from Belgium Application No. 2008/0405 filed 18 Jul. 2008 the entirety of both of which being hereby incorporated by reference.

BACKGROUND

The present invention relates to a door construction with self-closing pivot hinges integrated into the door panel according to the preamble of the first claim.

A self-closing pivot hinge of the type according to the invention is known from WO 2008/009736 A1. The known hinge is intended for integration into the door panel, i.e. for being included within the volume of the door panel, and enables the opening of the door in two directions with respect to the closed position, i.e. towards two open positions. The known hinge comprises a torsion spring for pushing the door back from one of the two open positions towards the closed position. The hinge further comprises blocking means for blocking the door in the open position.

Apart from that, door hinges are known from EP 1398442 A1 and U.S. Pat. No. 3,063,089 which are integrated into the door panel. In these door hinges, the hinge is provided with two cam elements having running surfaces which are shaped such that the door is pushed back to the closed position by a compression spring, which pushes the running surfaces onto each other. The user has to overcome a given force to open or close the door.

It is a disadvantage of the door hinges known from EP 1398442 A1 and U.S. Pat. No. 3,063,089 that the parts wear quickly as a result of forces which occur upon opening and closing the door. As a result, these hinge constructions are not suitable for application in reality.

SUMMARY

It is an aim of the invention to provide a door construction with self-closing pivot hinges integrated into the door panel, in which the parts are less subject to wear.

This aim is achieved according to the invention with a door construction having the characteristics of claim 1.

An analysis of the prior art has shown that the forces which cause a quick wearing of the parts of the pivot hinges are to a large extent caused by the fact that the total pivot axle is relatively long. In reality, the pivot axle is seldom or never perfectly aligned with the rotation axis of the door during installation of the door construction, the rotation axis being determined by the different connection points of the door to the door frame. In the construction of EP 1398442 A1, the rotation axis is determined by a pivot hinge at the bottom of the door panel, which is screwed into the floor, and a pivot hinge at the top of the door panel, which is screwed into the top side of the door frame. In reality, it is nearly impossible to align the pivot axles with each other in such a situation, because the direction of each pivot axle is determined by the direction in which the drill holes in the floor and the top side extend. In the door construction of U.S. Pat. No. 3,063,089, a solution was sought in combining the self-closing function into a single pivot hinge at the bottom, to be able to replace the axle at the top of the door by a simple rotation point. Such a construction doubles however the forces at the pivot hinge, which even increases the wear.

In the door construction according to the invention, a self-closing pivot hinge is provided both at the top and at the bottom, so that the forces can be taken up both at the top and at the bottom of the door. Further, the pivot hinges are provided for fixing to the side of the door opening, so that no holes need to be drilled into the floor and the top side of the door opening. Further, measures have been taken to limit the length of the pivot axle. This is mainly achieved in that the first cam element has at least one protrusion which upon rotation runs along a running surface with inclined parts of the second cam element, the second cam element being movably mounted in longitudinal direction of the pivot axle by means of a pen which is accommodated in a slotted hole of the second cam element, and the slotted hole extending at least partly between the inclined parts of the running surface. The result of this is that the coupling system—pen and slotted hole or holes—with which the second cam element is coupled to the second (or first) part of the pivot hinge, is located very close to the running surface, so that the length of the second cam element and consequently the total length of the pivot hinge can be considerably reduced. As a result, the pivot hinges at the top and bottom of the door can be made more compact than those of the prior art, which can considerably reduce the disadvantageous effect of a possible deviation of the pivot axle with respect to the rotation axis of the door panel. In particular, as a result of this the lever arm of the occurring forces can be considerably shortened. As a consequence, the wear to parts of the pivot hinges can be reduced and the whole can have a much longer life.

The pivot hinge in the door construction of the invention is generally provided for rotatably suspending a door panel in a door opening. The self-closing pivot hinge is of the type which is integrated into the door panel, such as in WO 2008/009736 A1. The hinge comprises a first part, provided for being fixed to the door panel, and a second part, provided to be fixed to a side of the door opening, the first and second parts being rotatable with respect to each other about a rotation axle from a closed position (0°) in which the door panel closes off the door opening in a first direction towards a first open position (e.g. +90°) and in a second direction, opposite the first direction, to a second open position (e.g. −90°). The hinge comprises a spring which extends along the rotation axle and provides a self-closing function to the pivot hinge.

The first part of the pivot hinge of the door construction according to the invention comprises a first cam element and the second part comprises a second cam element, or vice versa, the cam elements extending along the rotation axle and being pushed onto each other by a spring upon rotation of the first and second parts with respect to each other, the cam elements being shaped such that they define the open and closed positions of the door panel and that they push the door panel towards the closed position from substantially each intermediate position between the open and closed positions under the influence of the spring pressure.

With "substantially each intermediate position" is intended a range of more than 50% of the rotation circle of the door (e.g. for a door opening to +90° and −90° a range larger than +45° to −45°, i.e. more than 90° of the total rotation circle of 180°), preferably at least 66.6% of the rotation circle (i.e. at least 120° for a total rotation circle of 180°), more preferably at least 80% of the rotation circle (i.e. at least 136° for a total rotation circle of 180°), most preferably at least 90% of the rotation circle (i.e. at least 162° for a total rotation circle of 180°).

In a preferred embodiment, the first cam element comprises two protrusions on opposite sides of the rotation axle, which run along the running surface of the second cam element upon rotation. Preferably the open and closed positions of the door panel are defined by respectively first and second recesses in the running surface. This forms a simple construction for the cam elements. Furthermore, by providing the protrusions on opposite sides, the occurring forces are spread.

Further preferred embodiments are apparent from the dependent claims, in which amongst others a number of predetermined parameters are described by means of which the force can be optimised with which the door panel is pushed to the closed position under the influence of the spring pressure. These parameters are preferably also chosen for obtaining the shortest possible length of the hinges, such as for example a larger diameter of the cam elements. Other preferred embodiments comprise an integrated adjustable pre-tensioning device for the spring and/or an integrated stop for delimiting the rotation circle of the door.

BRIEF DESCRIPTION OF THE DRAWINGS

The invention will be further elucidated by means of the following description and the appended figures.

DETAILED DESCRIPTION

Figure 1:
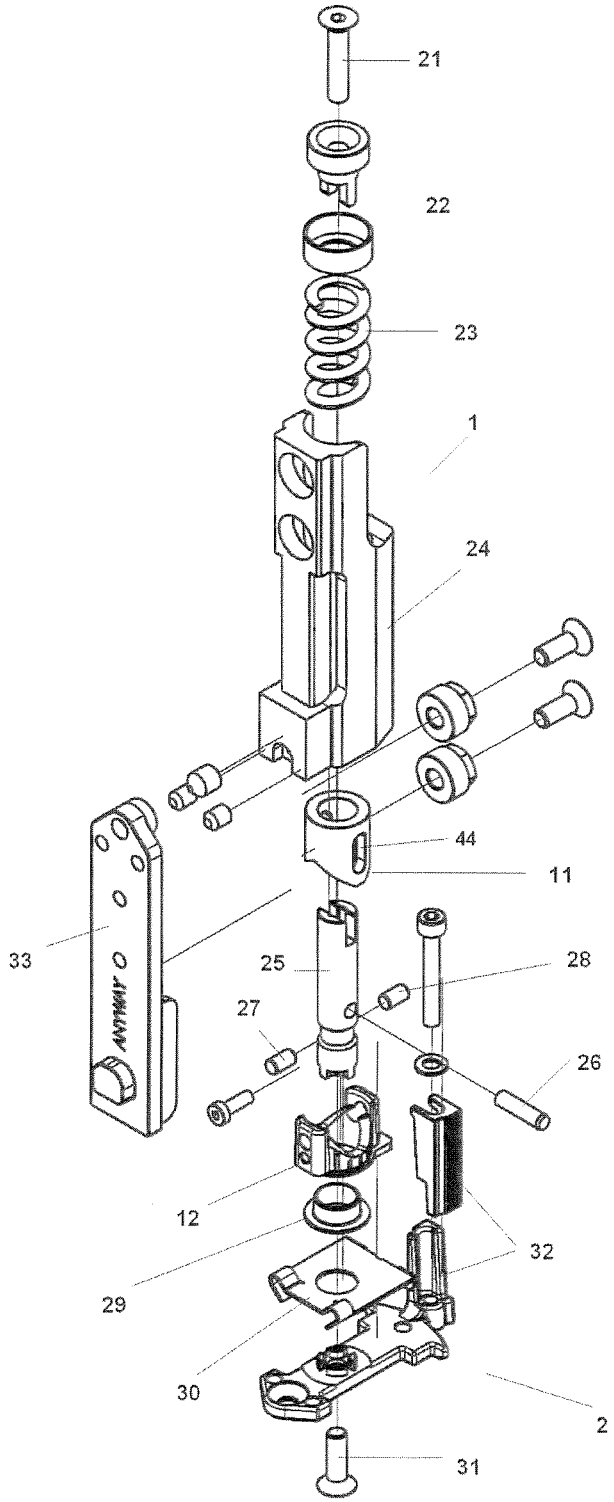
FIGS. 1-14 show different views of a preferred embodiment of the pivot hinge of a door construction according to the invention, or parts thereof, which is intended for integration in a door panel of for example an interior door.
Figure 2:
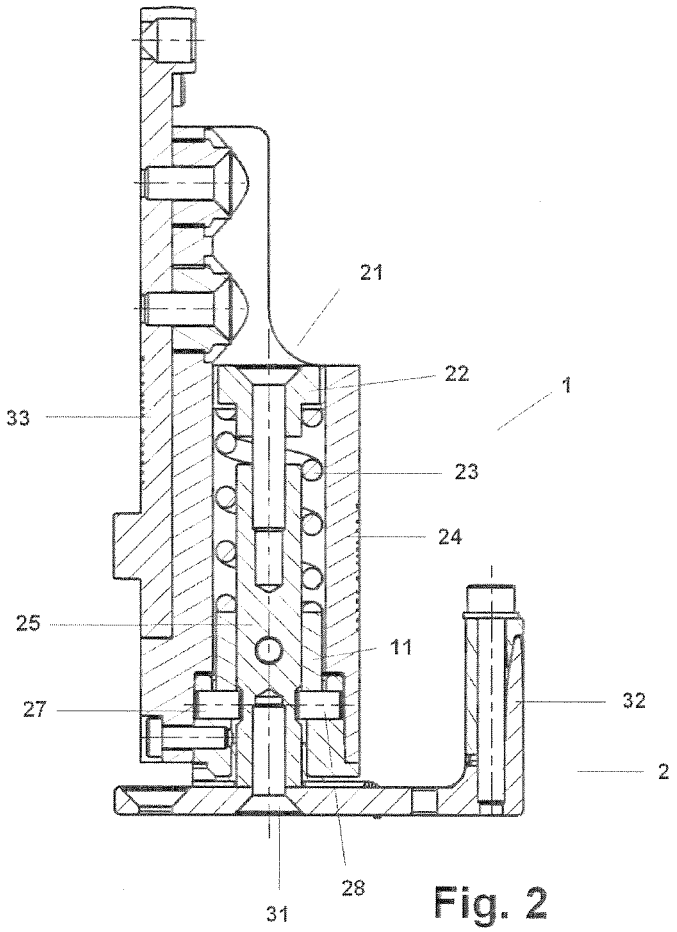
Figure 3:
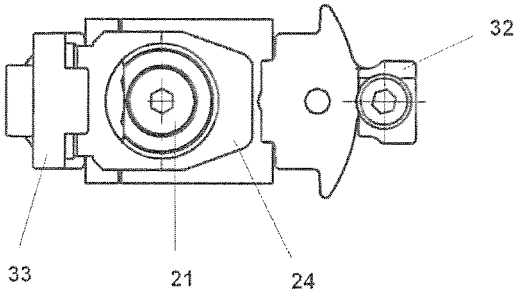
Figure 4:
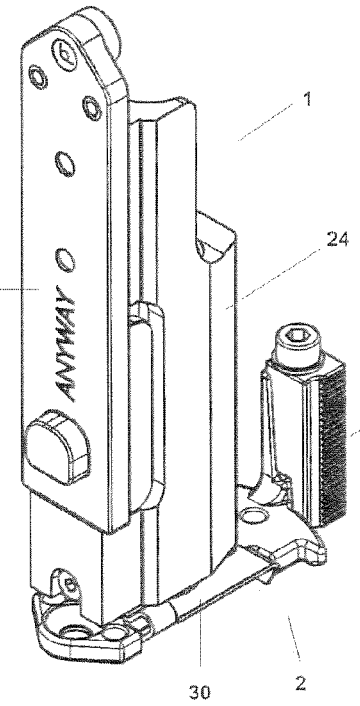
Figure 6:
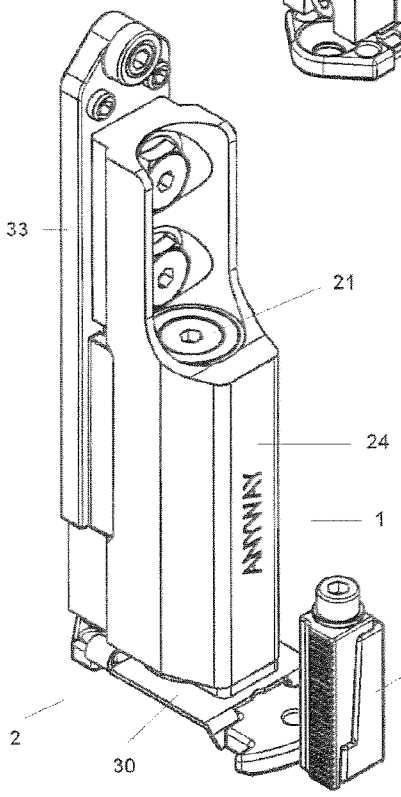
Figure 5:
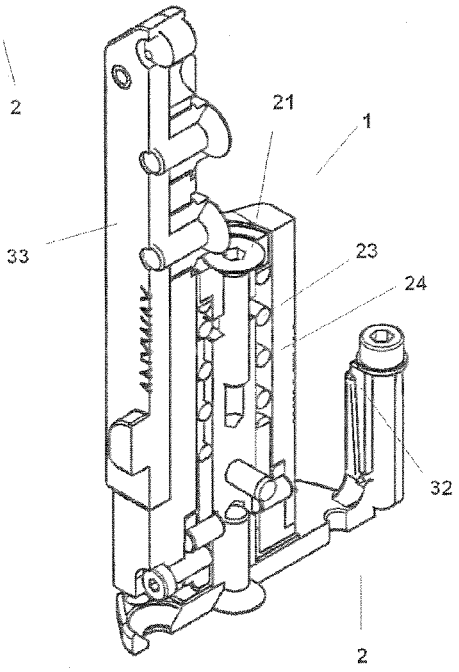

The shown hinge comprises a first part 1, provided for being fixed to the door panel (in this case an (interior) door), and a second part 2, provided for being fixed to a side of the opening, the first and second parts being rotatable with respect to each other about a rotation axle 25 from a closed position (0°) in which the door panel closes off the opening in a first direction to a first open position (+90°) and in a second direction, opposite the first direction, to a second open position (−90°). The hinge comprises a spring 23 which extends along the rotation axle 25 and which provides a self-closing function to the pivot hinge.

The first part comprises a first cam element 12 and the second part comprises a second cam element 11, the cam elements extending along the rotation axle 25 and being pushed onto each other by the spring 23 upon rotation of the first and second parts with respect to each other. The cam elements are shaped such that they define the open and closed positions of the door panel and that they push the door panel towards the closed position from substantially each intermediate position between the open and closed positions under the influence of the spring pressure.

The first cam element 12 comprises two pens 27 and 28 which form protrusions which run along a running surface of the second cam element 11 during rotation. The open and closed positions of the door panel are defined by respectively first 41 and second recesses 42 in the running surface. This forms a simple construction for the cam elements. When the door is held in one of the open positions, it suffices to give the door a slight pull to let it close by itself. The first and second cam elements can however also be carried out in any other way known to the person skilled in the art.

In the second cam element 11, the first and second recesses 41, 42 are spaced from each other in the direction of the rotation axle by a predetermined height difference. This height difference is a first parameter which is chosen for creating a predetermined force under the influence of the spring pressure for pushing the door panel to the closed position. In the embodiment shown, the height difference is about 1 cm. In general, the height difference is preferably 0.5 to 2 cm. The larger the height difference, the stronger the force.

The first recesses 41 (open positions) are preferably kept as small as possible in order to keep the range in which the door is pushed towards the closed position as large as possible and in order to prevent that the user has to develop too much force to pull the door loose from the defined open position.

In the second cam element 11, the running surface has a steep slanting progression 43 between the first and second recesses 41, 42 at a predetermined slope angle. This slope angle is a second parameter which is chosen for creating a predetermined force under the influence of the spring pressure for pushing the door panel to the closed position. In the embodiment shown, slope angle is about 45°. In general, the slope angle is preferably 30 to 60°. The greater the slope angle, the stronger the force.

In the embodiment shown, the cam elements 11, 12 (or more specifically the running surface) have a diameter of about 2 cm. This is a third parameter with which the force for closing the door can be determined: the larger the diameter, the stronger the force and also the more even the force. The choice of this parameter can furthermore also influence the length of the hinge. In general the diameter is preferably 1.5 to 3 cm. It is remarked that these diameters are only applicable to hinges which are integrated into the door panel. Non-integrated hinges normally have much smaller diameters, which makes it difficult or impossible to provide a self-closing function in such hinges. The symmetrical construction with the two pens 27, 28 also implies an enlargement of the contact area between the cam elements and as such an improved transfer of the force of the spring for closing the door.

Figure 13:
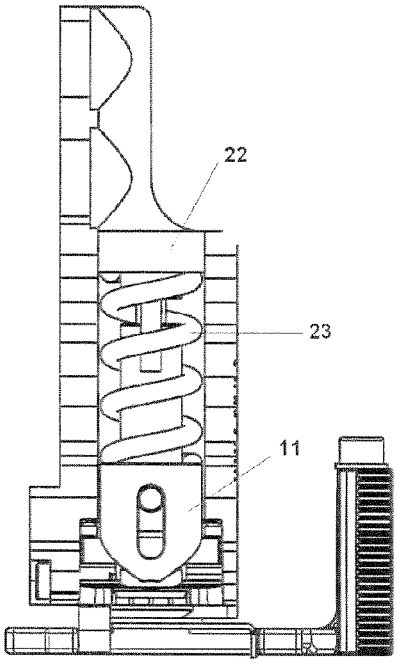
Figure 14:
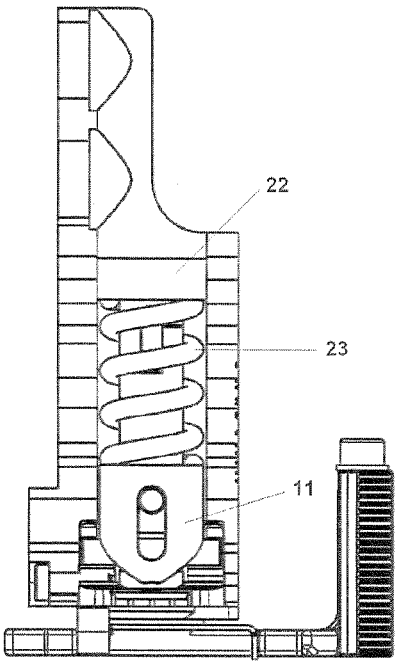
Figure 15:
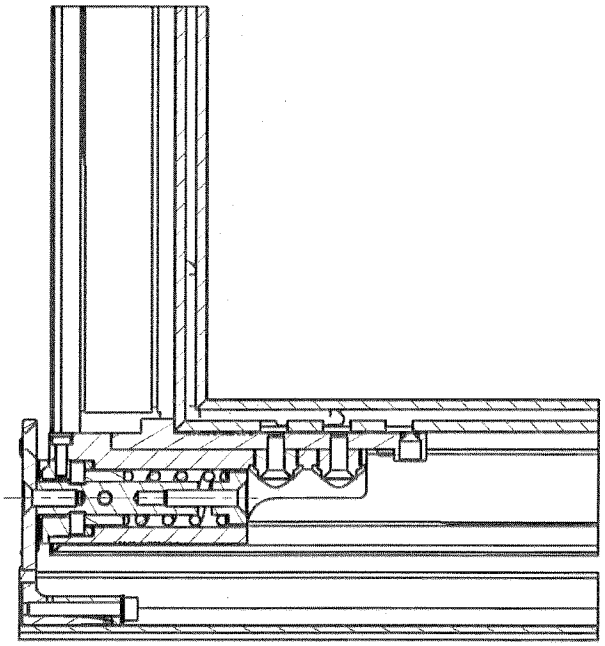
FIGS. 15-18 show different views of the pivot hinge of FIGS. 1-14 built into a door panel at the bottom and at the top.
Figure 16:
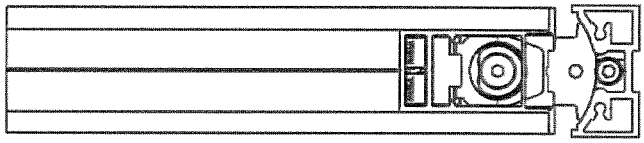
Figure 17:
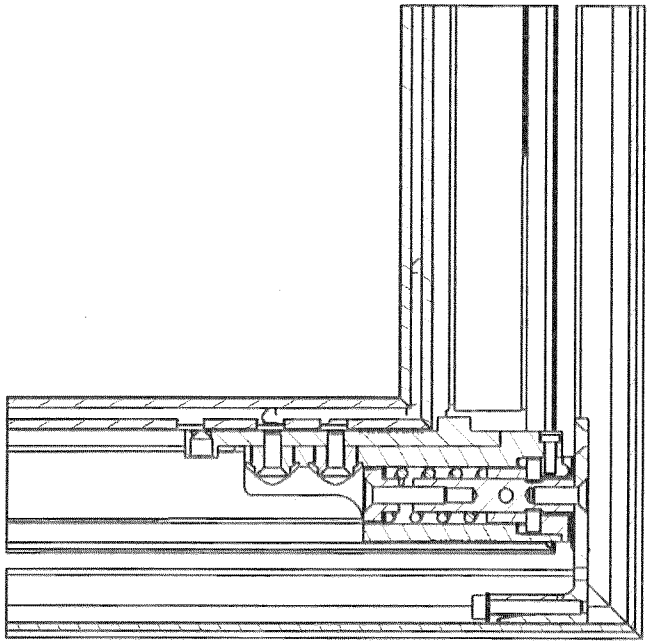
Figure 18:
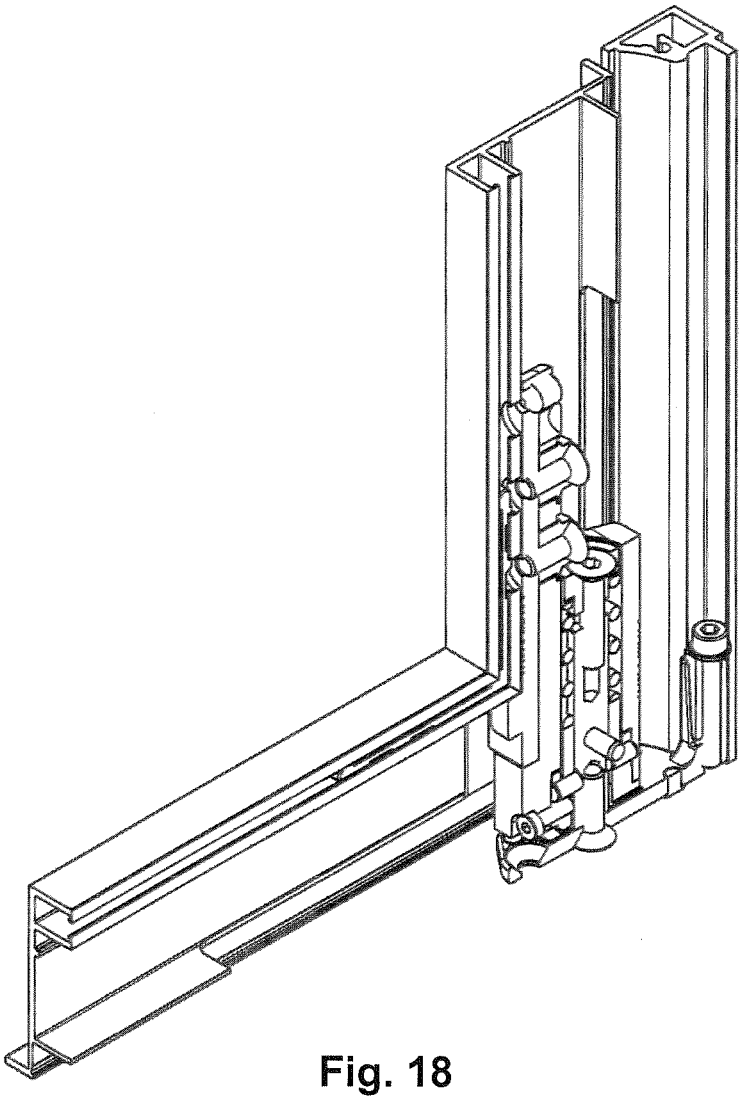

A fourth parameter for determining the force for closing the door is given by the force developed by the spring itself. In the embodiment shown, this force is adjustable (see FIGS. 13 and 14). The adjustment system for the pre-tension of the spring is directed along the rotation axle 25 of the pivot hinge, so that it also adds little to the length of the pivot axle.

Figure 7:
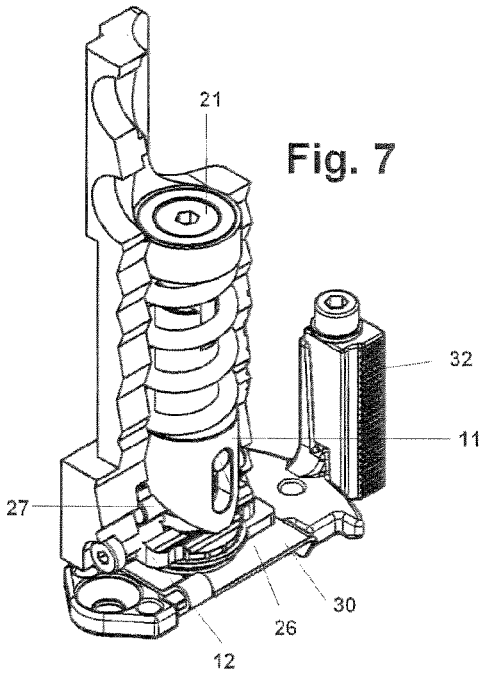

The first cam element 12 is fixedly connected to the first part 1, which is fixed to the door panel, and the second cam element 11 is coupled to the second part 2, which is fixed to the side of the opening. The second cam element is movably mounted in longitudinal direction of the rotation axle. Upon opening the door, it is pushed upwards by the pens 27-28 of the first cam element and thereby the spring 23 is compressed. This is clearly shown in FIGS. 7-9: the second cam element 11 slides up and down along the pen 26 which is provided on the axle 25 and which is accommodated in the slotted holes 44 of the second cam element 11. As shown in the figures, these slotted holes 44 extend partly between the inclined parts 43 if the running surface, i.e. within the height difference between the first and second recesses 41, 42, so that the dimensions of the second cam element 11 remain limited, which is to the benefit of the total length of the pivot axle.

In the embodiment shown, the spring 23 functions as a compression spring. The compression spring is compressed between the second cam element 11 and a sleeve 22. The position of this sleeve can be adjusted in height direction by means of a setting screw 21 in the centre of the sleeve 22, which engages in a screw-thread in the centre of the rotation axle 25. By rotating the screw, the compression spring 23 is compressed to a higher or lesser extent and consequently a pre-tension is set. This embodiment of the pre-tension adjustment has the advantage of adding little length to the pivot axle. The pre-tension adjustment can however also be carried out in any other way known to the person skilled in the art.

Figure 8:
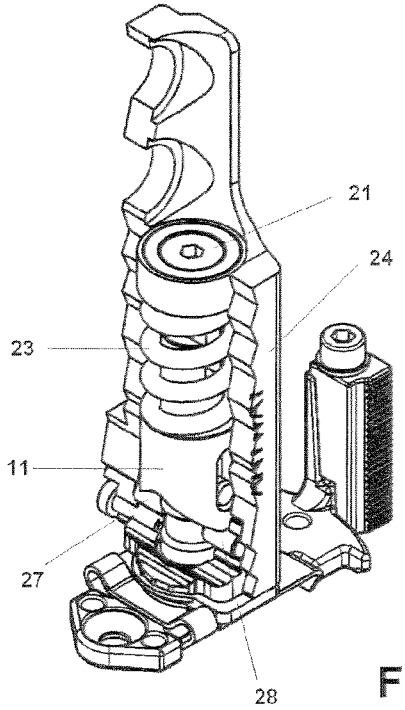
Figure 9:
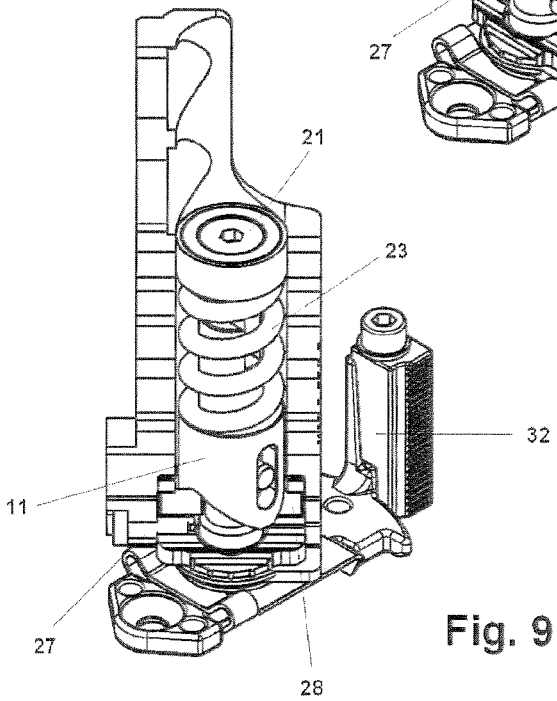
Figure 10:
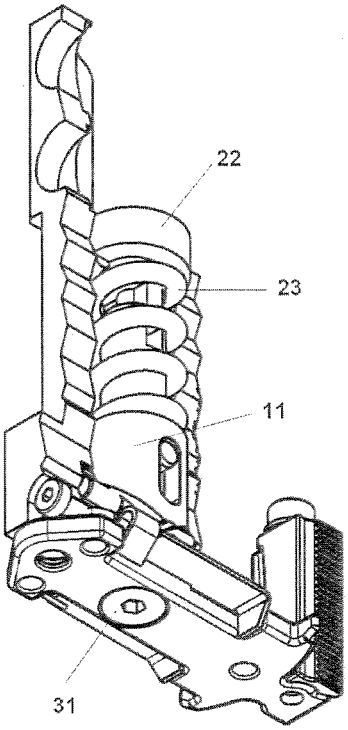
Figure 11:
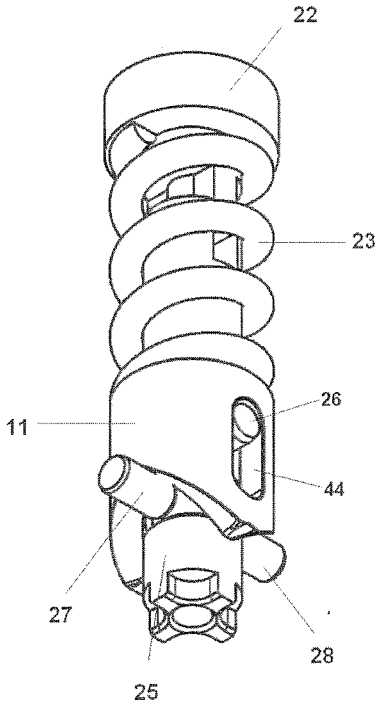
Figure 12:
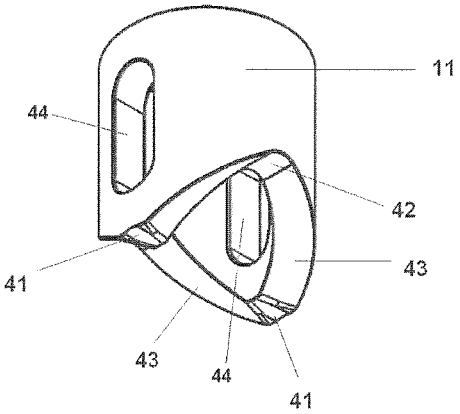

The shown self-closing pivot hinge further comprises an integrated stop 30 for delimiting the rotation of the door panel to the open positions. This is shown in FIG. 8: at the bottom the first cam element 12 strikes an upstanding part of the stop, so that the hinge cannot rotate any further than 90°.

The shown self-closing pivot hinge further comprises a device 32 with which the second part 2 can be clamped in a complementary groove in a door frame at substantially any height position. This principle has already been extensively discussed in WO 2008/009736 A1 and therefore needs no further explanation here.

The shown self-closing pivot hinge further comprises a mounting element 33, with which the first part 1 is fixed to the door panel. This is done by means of a number of screws, which also enable a step-less adjustment in height and depth directions. This principle has already been extensively discussed in WO 2008/009736 A1 and therefore needs no further explanation here.

The figures further show the following parts:

- a housing 24, forming part of the first part 1, which encloses and protects the spring, while the setting screw 21 remains accessible;
- a slide element 29 which limits the friction between the first, rotatable cam element 11 and the stop 30 which has a fixed position;
- a screw 31 at the bottom, which fixes the rotation axle 25 and the parts coupled thereto on the second part 2 of the hinge.

This construction with compression spring instead of the torsion spring of WO 2008/009736 A1 is much more reliable, as the spring is loaded to a lesser extent and also much more evenly. Also, less noise occurs, as totally different forces are created on and around this spring technique which is also less damaging to the other components.

The FIGS. 15-18 show a completely mounted door construction. This shows the excellent accessibility of the setting screws of the pivot hinge for the pre-tension of the spring and the height and depth adjustments, even in mounted state. As shown, a pivot hinge is provided at the top as well as at the bottom, so that the occurring forces are spread.

The invention claimed is:

1. A door construction comprising a door panel and at the top and at the bottom each time a self-closing pivot hinge integrated into the door panel for rotatably suspending the door panel in a door opening, each of the pivot hinges comprising:

- a first part, provided for being fixed to the door panel, and a second part, provided for being fixed to a side of the door opening, the first and second parts being rotatable with respect to each other about a rotation axle from a closed position in which the door panel closes off the door opening in a first direction towards a first open position and in a second direction, opposite the first direction, towards a second open position;
- a spring which extends along the rotation axle and which provides a self-closing function to the pivot hinge;
- a first cam element coupled to the first part and a second cam element coupled to the second part or vice versa, each cam elements having a predefined diameter, the cam elements extending along the rotation axle and being pushed onto each other by the spring upon rotation of the first and second parts with respect to each other, the cam elements being shaped such that they define the open and closed positions of the door panel and that they push the door panel towards the closed position from substantially each intermediate position between the open and closed positions under the influence of the spring pressure;
- the first cam element comprising protrusions on opposite sides of the rotation axle, which upon rotation run along a running surface with inclined parts of the second cam element;
- the second cam element being movably mounted in longitudinal direction of the rotation axle by means of a pen which is accommodated in slotted holes on opposite sides of the second cam element;

characterised in that each of the slotted holes extends at least partly between the inclined parts of the running surface.

2. Door construction according to claim 1, characterised in that the open and closed positions of the door panel are defined by respectively first and second recesses in the running surface between the inclined parts.

3. Door construction according to claim 2, characterised in that the first and second recesses are spaced from each other in the direction of the rotation axle by a predetermined height difference, the height difference being chosen for creating a predetermined force under the influence of the spring pressure for pushing the door panel to the closed position.

4. Door construction according to claim 3, characterised in that the height difference is 0.5 to 2 cm.

5. Door construction according to claim 3, characterised in that the height difference is about 1 cm.

6. Door construction according to claim 1, characterised in that the inclined parts have a predetermined slope angle, the slope angle being chosen for creating a predetermined force under the influence of the spring pressure for pushing the door panel to the closed position.

7. Door construction according to claim 6, characterised in that the slope angle is 30° to 60°.

8. Door construction according to claim 6, characterised in that the slope angle is about 45°.

9. Door construction according to claim 1, characterised in that each of the cam elements has a diameter of 1.5 cm to 3 cm.

10. Door construction according to claim 1, characterised in that each of the cam elements has a diameter of about 2 cm.

11. Door construction according to claim 1, characterised in that the first cam element is fixedly connected to the first part, which is fixed to the door panel, and the second cam element is coupled to the second part, which is fixed to the side of the opening, the second cam element being movably mounted in longitudinal direction of the rotation axle for compressing the spring.

12. Door construction according to claim 1, characterised in that the spring functions as a compression spring and that the pivot hinge further comprises an adjustable pre-tensioning device for setting a pre-tension of the spring.

13. Door construction according to claim 9, characterised in that the compression spring is compressed between the second cam element and a pre-tensioning element which extends along the rotation axle of the hinge, the pre-tensioning device being formed by an adjustment of the distance between the second cam element and the pre-tensioning element.

14. Door construction according to claim 10, characterised in that the position of the pre-tensioning element is adjustable in the direction of the rotation axle by means of a setting screw in the centre of the rotation axle.

15. Door construction according to claim 1, characterised in that at least one of the pivot hinges comprises an integrated stop for delimiting the rotation of the door panel to the open positions.

* * * * *